US011688276B2

(12) United States Patent
Barson et al.

(10) Patent No.: US 11,688,276 B2
(45) Date of Patent: Jun. 27, 2023

(54) SELF-CALIBRATING FIRE SENSING DEVICE

(71) Applicant: Honeywell International Inc., Charlotte, NC (US)

(72) Inventors: Michael Barson, Nuneaton (GB); Benjamin Wolf, Leicester (GB); Christopher Dearden, Melton Mowbray (GB)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/395,624

(22) Filed: Aug. 6, 2021

(65) Prior Publication Data

US 2022/0005344 A1 Jan. 6, 2022

Related U.S. Application Data

(63) Continuation of application No. 16/919,517, filed on Jul. 2, 2020, now Pat. No. 11,127,284.

(51) Int. Cl.
*G08B 29/28* (2006.01)
*G08B 17/107* (2006.01)

(52) U.S. Cl.
CPC ..... *G08B 29/28* (2013.01); *G08B 17/107* (2013.01)

(58) Field of Classification Search
CPC ..... G08B 29/20; G08B 29/24; G08B 29/28; G08B 29/145; G08B 29/043; G08B 29/185; G08B 17/10; G08B 17/103; G08B 17/107
See application file for complete search history.

(56) References Cited

U.S. PATENT DOCUMENTS 4,300,133 A 11/1981 Solomon
4,654,644 A 3/1987 Dobrzanski
(Continued)

FOREIGN PATENT DOCUMENTS

CN 202057569 U 11/2011
CN 103674843 3/2014
(Continued)

OTHER PUBLICATIONS

Extended European Search Report for related EP Application No. 21182189.7, dated Dec. 20, 2021 (7 pgs).
(Continued)

*Primary Examiner* — Andrew W Bee
(74) *Attorney, Agent, or Firm* — Brooks, Cameron & Huebsch, PLLC

(57) ABSTRACT

Devices, methods, and systems for a self-calibrating fire sensing device are described herein. One device includes a first transmitter light-emitting diode (LED) configured to emit a first light, a second transmitter LED configured to emit a second light, a first photodiode on-axis with the first transmitter LED, wherein the first photodiode is configured to select a first gain or a second gain of a first variable gain amplifier and detect an LED emission level of the first light responsive to selecting the first gain and detect a scatter level of the second light responsive to selecting the second gain, a second photodiode on-axis with the second transmitter LED, wherein the second photodiode is configured to select a third gain or a fourth gain of a second variable gain amplifier and detect an LED emission level of the second light responsive to selecting the third gain and detect a scatter level of the first light responsive to selecting the fourth gain, and a controller configured to recalibrate the fourth gain responsive to the detected LED emission level of
(Continued)

the first light and recalibrate the second gain responsive to the detected LED emission level of the second light.

16 Claims, 5 Drawing Sheets

(56) References Cited

U.S. PATENT DOCUMENTS

| | | | | |
|---|---|---|---|---|
| 5,523,743 | A | 6/1996 | Rattman et al. | |
| 5,798,701 | A | 8/1998 | Bernal et al. | |
| 5,936,533 | A | 8/1999 | Bernal et al. | |
| 7,934,411 | B2 | 5/2011 | Koch | |
| 8,933,811 | B2 | 1/2015 | Hoejmose | |
| 9,659,485 | B2 | 5/2017 | Piccolo, III | |
| 9,959,748 | B2 | 5/2018 | Moffa | |
| 11,024,154 | B1 | 6/2021 | Lang et al. | |
| 2002/0060632 | A1 | 5/2002 | Kadwell et al. | |
| 2007/0229824 | A1 | 10/2007 | Politze et al. | |
| 2011/0255087 | A1 | 10/2011 | Alexander et al. | |
| 2017/0046935 | A1* | 2/2017 | Allemann | G08B 29/24 |
| 2018/0252654 | A1 | 9/2018 | Lincoln et al. | |
| 2019/0164415 | A1* | 5/2019 | Kuhn-Matysiak | G08B 29/20 |
| 2020/0250963 | A1 | 8/2020 | Rodriguez | |
| 2021/0065536 | A1 | 3/2021 | Dearden et al. | |
| 2021/0209918 | A1* | 7/2021 | Birnkrant | G08B 17/107 |

FOREIGN PATENT DOCUMENTS

| | | | |
|---|---|---|---|
| DE | 20215640 | | 2/2003 |
| EP | 0571841 | A1 | 12/1993 |
| EP | 0897692 | A2 | 2/1999 |
| EP | 1194908 | A1 | 4/2002 |
| GB | 2176600 | | 12/1986 |
| GB | 2327752 | A | 2/1999 |
| GB | 2459322 | | 10/2009 |
| JP | H0844972 | A | 2/1996 |
| WO | 0072282 | A1 | 11/2000 |
| WO | 0227293 | | 4/2002 |
| WO | 2014194379 | A1 | 12/2014 |

OTHER PUBLICATIONS

Chinese Notification to Grant Patent Right for Invention for related Chinese Application No. 202110753096.9, dated Sep. 15, 2022 (Original & Translation Copies; 7pgs total).

* cited by examiner

SELF-CALIBRATING FIRE SENSING DEVICE

PRIORITY INFORMATION

This application is a Continuation of U.S. application Ser. No. 16/919,517, filed Jul. 2, 2020, the contents of which are incorporated herein by reference.

TECHNICAL FIELD

The present disclosure relates generally to devices, methods, and systems for a self-calibrating optical smoke chamber within a fire sensing device.

BACKGROUND

Large facilities (e.g., buildings), such as commercial facilities, office buildings, hospitals, and the like, may have a fire alarm system that can be triggered during an emergency situation (e.g., a fire) to warn occupants to evacuate. For example, a fire alarm system may include a fire control panel and a plurality of fire sensing devices (e.g., smoke detectors), located throughout the facility (e.g., on different floors and/or in different rooms of the facility) that can sense a fire occurring in the facility and provide a notification of the fire to the occupants of the facility via alarms. Fire sensing devices can include one or more sensors. The one or more sensors can include an optical smoke sensor, a heat sensor, a gas sensor, and/or a flame sensor, for example.

Over time components of a fire sensing device can degrade and/or become contaminated and fall out of their initial operational specifications. For example, an output of a light-emitting diode (LED) used in an optical scatter chamber of a smoke detector can degrade with age and/or use. These degraded components can prevent the fire sensing device from detecting a fire at an early enough stage. As such, codes of practice require sensitivity testing (e.g., alarm threshold verification testing) of smoke detectors at regular intervals. However, accurate sensitivity testing on site can be impractical due to access problems and the need to deploy specialist equipment to carry out the testing. Consequently, rudimentary functionality tests are often done in lieu of accurate sensitivity tests which are misleading by inaccurately depicting the sensitivity of a smoke detector as being verified.

In some countries, because an accurate sensitivity of the smoke detector may not be able to be determined and/or testing is not performed, devices are required to be replaced after a particular time period. For example, in Germany, even the most advanced smoke detector must be replaced after 8 years, even though the device may still be performing accurately. This can create unnecessary waste which can negatively impact the environment.

DETAILED DESCRIPTION

Figure 1:
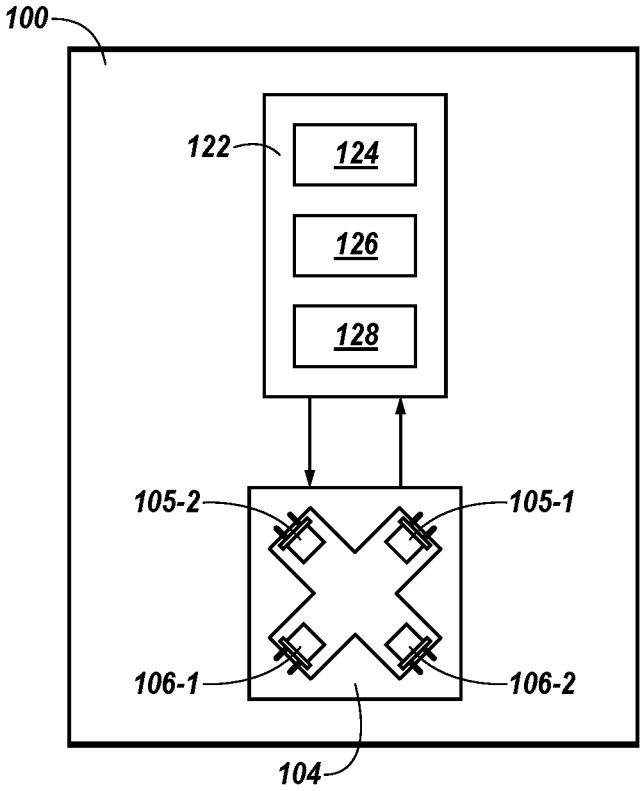
FIG. 1 illustrates a block diagram of a self-calibrating fire sensing device in accordance with an embodiment of the present disclosure.

Devices, methods, and systems for a self-calibrating optical smoke chamber, within a fire sensing device are described herein. One device includes a first transmitter LED configured to emit a first light, a second transmitter LED configured to emit a second light, a first photodiode on-axis with the first transmitter LED, wherein the first photodiode is configured to select a first gain or a second gain of a first variable gain amplifier and detect an LED emission level of the first light responsive to selecting the first gain and detect a scatter level of the second light responsive to selecting the second gain, and a second photodiode on-axis with the second transmitter LED, wherein the second photodiode is configured to select a third gain or a fourth gain of a second variable gain amplifier and detect an LED emission level of the second light responsive to selecting the third gain and detect a scatter level of the first light responsive to selecting the fourth gain and a controller configured to recalibrate the fourth gain responsive to the detected LED emission level of the first light and/or recalibrate the second gain responsive to the detected LED emission level of the second light. The controller can use software gain functions to calibrate and/or recalibrate gains. In some examples, the controller can be configured to recalibrate the second gain responsive to the detected LED emission level of the first light, recalibrate the fourth gain responsive to the detected LED emission level of the second light, recalibrate the first gain responsive to the detected LED emission level of the second light and/or recalibrate the third gain responsive to the detected LED emission level of the first light using software gain functions.

In contrast to previous smoke detectors in which a maintenance engineer would have to manually test sensitivity of a smoke detector and replace the smoke detector if the smoke sensitivity was incorrect, the smoke detectors in accordance with the present disclosure can test, calibrate, and/or recalibrate themselves. Accordingly, fire sensing devices in accordance with the present disclosure may take significantly less maintenance time to test and can be tested, calibrated, and/or recalibrated continuously and/or on demand, and can more accurately determine the ability of a fire sensing device to detect an actual fire. As such, self-calibrating fire sensing devices may have extended service lives and be replaced less often resulting in a positive environmental impact.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 104 may reference element "04" in FIG. 1, and a similar element may be referenced as 204 in FIG. 2A.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 illustrates a block diagram of a self-calibrating fire sensing device 100 in accordance with an embodiment of the present disclosure. The fire sensing device 100 includes a controller 122 and an optical scatter chamber 104.

The controller 122 can include a memory 124, a processor 126, and circuitry 128. Memory 124 can be any type of storage medium that can be accessed by processor 126 to perform various examples of the present disclosure. For example, memory 124 can be a non-transitory computer readable medium having computer readable instructions (e.g., computer program instructions) stored thereon that are executable by processor 126 to test, calibrate, and/or recalibrate a fire sensing device 100 in accordance with the present disclosure. For instance, processor 126 can execute the executable instructions stored in memory 124 to emit a first light and a second light, select a first gain or a second gain, detect an LED emission level of the first light responsive to selecting the first gain and detect scatter of the second light responsive to selecting the second gain, recalibrate (e.g., increase or decrease) the second gain responsive to the detected LED emission level of the second light. In some examples, memory 124 can store the detected LED emission level of the first light and/or the detected scatter of the second light.

The optical scatter chamber 104 can include transmitter LEDs 105-1 and 105-2 and photodiodes 106-1 and 106-2 to measure the aerosol density level by detecting scatter. Scatter can be light from the transmitter LEDs 105-1 and/or 105-2 reflecting, refracting, and/or diffracting off of particles and can be received by the photodiodes 106-1 and/or 106-2. The amount of light received by the photodiodes 106-1 and/or 106-2 can be used to determine the aerosol density level.

Transmitter LED 105-1 can emit a first light and transmitter LED 105-2 can emit a second light. As shown in FIG. 1, photodiode 106-1 can be on-axis with (e.g., directly across from) transmitter LED 105-1 such that photodiode 106-1 directly receives the first light and receives a scattering of the second light. Photodiode 106-2 can be on-axis with transmitter LED 105-2 such that photodiode 106-2 directly receives the second light and receives a scattering of the first light. Photodiode 106-1 can detect an LED emission level of the first light and detect a scatter level of the second light. Photodiode 106-2 can detect an LED emission level of the second light and detect a scatter level of the first light.

Transmitter LEDs 105-1 and 105-2, which may be referred to herein collectively as transmitter LEDs 105, can have varying LED emission levels due to, for example, manufacturing variations. As such, transmitter LEDs 105 may require calibration prior to use. The fire sensing device 100 can calibrate the transmitter LEDs 105 by having a known aerosol density level injected into the optical scatter chamber 104. The photodiodes 106-1 and 106-2, which may be referred to herein collectively as photodiodes 106, can detect scatter levels and the controller 122 can compare the detected scatter levels with the known aerosol density level to calculate a sensitivity for each scatter path. For example, transmitter LED 105-1 can emit a first light and photodiode 106-2 can detect the scatter level from the first light scattering off of the particles of the known aerosol density level. The controller 122 can calculate a sensitivity, based on the detected scatter level and the known aerosol density level, for the scatter path of transmitter LED 105-1 to photodiode 106-2. The controller 122 can similarly calculate a sensitivity for the scatter path of transmitter LED 105-2 to photodiode 106-1 and store the sensitivity. The sensitivity for each scatter path can be stored in memory 124.

In some examples, the sensitivity can be improved by recalibrating a gain used to amplify the input signal of a photodiode 106. For example, an amplifier gain can be increased to increase the voltage and/or current of the input signal of photodiode 106-2 to detect the first light from transmitter LED 105-1 as the first light from transmitter LED 105-1 weakens over time. A gain of the amplifier can be recalibrated (e.g., modified) responsive to the detected scatter level and/or LED emission level. For example, a gain of the amplifier can be recalibrated responsive to a calculated sensitivity of a scatter path being less than a threshold sensitivity.

Figure 3:
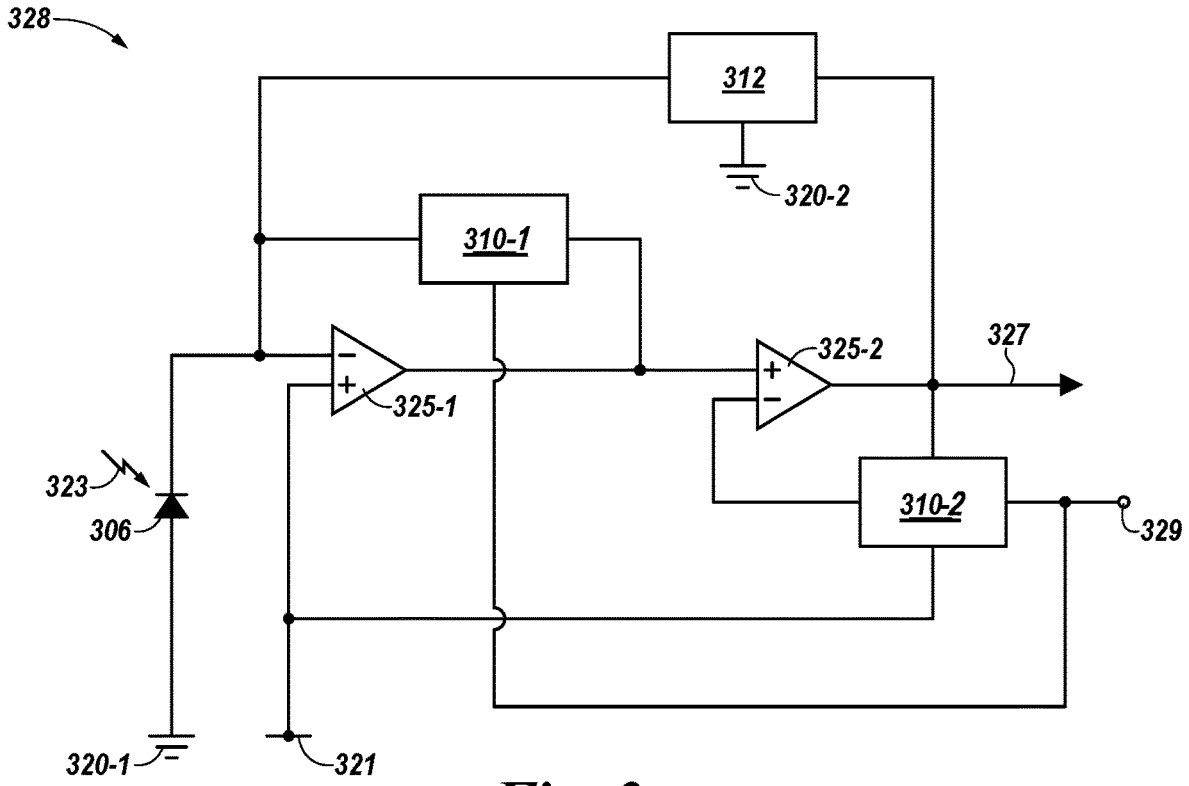
FIG. 3 illustrates circuitry of a self-calibrating fire sensing device in accordance with an embodiment of the present disclosure.

Photodiodes 106 can select between a number of gains of a variable gain amplifier (e.g., operational amplifier 325-1 and 325-2 further described in FIG. 3). In some examples, detecting an LED emission level of an on-axis transmitter LED 105 can require less gain than detecting scatter of an off-axis transmitter LED 105 because the light from the on-axis transmitter LED 105 is direct light (e.g., higher intensity) and the light from the off-axis transmitter LED 105 is indirect light (e.g., lower intensity). For example, photodiode 106-1 can select a first gain to detect an LED emission level of the first light from transmitter LED 105-1 or select a second gain to detect a scatter level of the second light from transmitter LED 105-2. Similarly, photodiode 106-2 can select a third gain to detect an LED emission level of the second light from transmitter LED 105-2 or select a fourth gain to detect a scatter level of the first light from transmitter LED 105-1.

In a number of embodiments, a fault (e.g., an error) can be triggered responsive to the detected LED emission level or the detected scatter level. For example, the controller 122 can compare the detected LED emission level to a threshold LED emission level and trigger a fault responsive to the detected LED emission level being below the threshold LED emission level. Another example can include the controller 122 comparing the detected LED emission level to a previously detected LED emission level and triggering a fault responsive to the detected LED emission level being less than the previously detected LED emission level.

Each amplifier gain can be calibrated by storing the initial detected LED emission level and each amplifier gain in memory 124. Over time LED emission levels of transmitter LEDs 105 can decrease, reducing the received light by the photodiode 106, which could lead to the fire sensing device 100 malfunctioning.

The amplifier gain used by photodiode 106 for detecting scatter levels can be recalibrated as the transmitter LED degrades over time. Controller 122 can recalibrate the gain responsive to the detected LED emission level and/or the detected scatter level. For example, the controller 122 can initiate a recalibration of the gain responsive to comparing the detected LED emission level to a threshold LED emission level and determining the detected LED emission level is below the threshold LED emission level. In some examples, the controller 122 can recalibrate the gain responsive to determining a difference between the detected LED emission level and the initial detected LED emission level is greater than a threshold value and/or responsive to determining the detected LED emission level is less than a previously detected LED emission level.

Figure 2A:
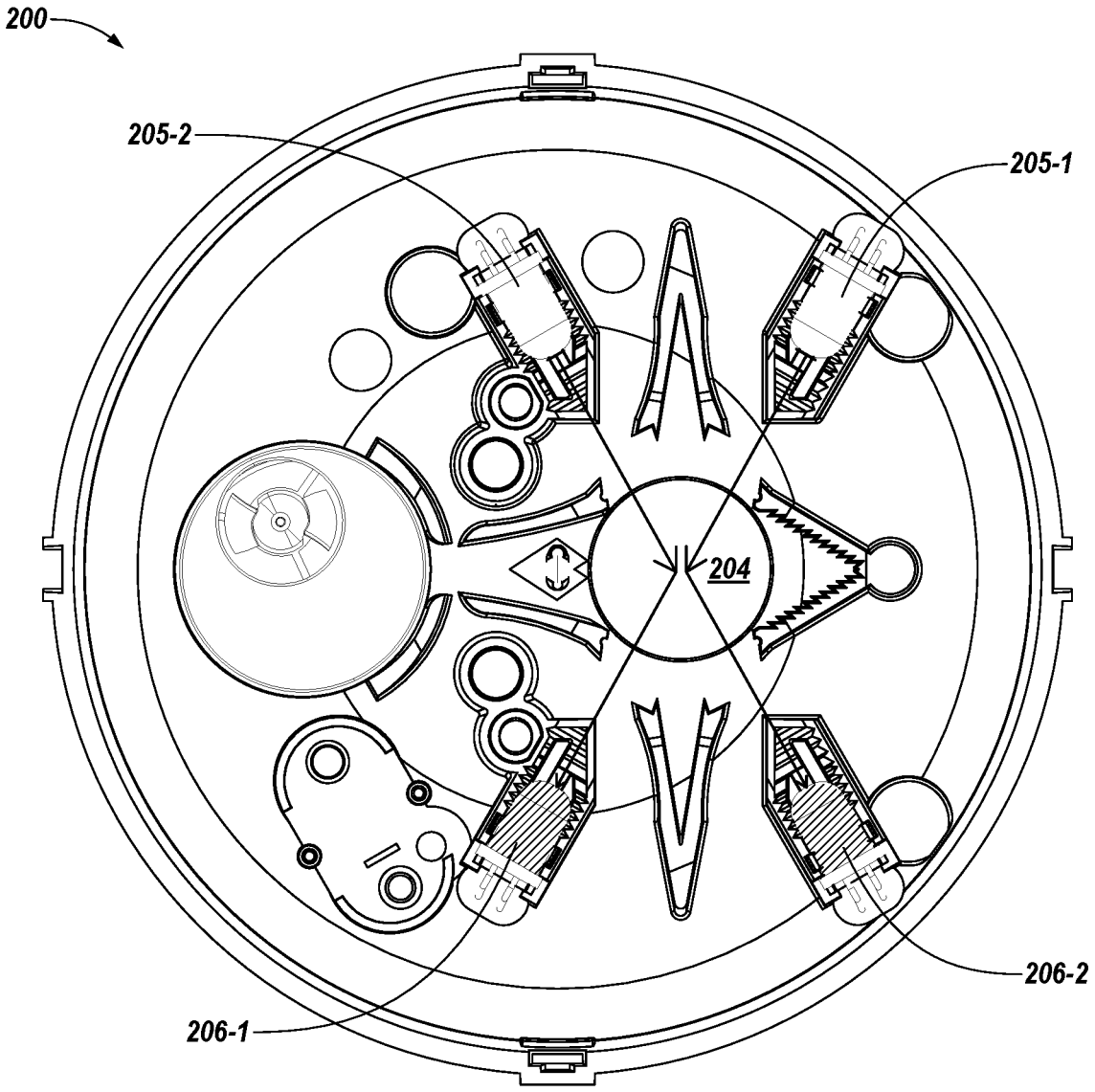
FIG. 2A illustrates an example of a self-calibrating fire sensing device in accordance with an embodiment of the present disclosure.

FIG. 2A illustrates an example of a self-calibrating fire sensing device 200 in accordance with an embodiment of the present disclosure. The fire sensing device 200 can be, but is not limited to, a fire and/or smoke detector of a fire control system, and can be, for instance, fire sensing device 100 previously described in connection with FIG. 1. The self-calibrating fire sensing device 200 illustrated in FIG. 2A can be a dual optical smoke chamber. In some examples, the fire sensing device 200 can use two scatter angles and/or two wavelengths.

A fire sensing device 200 can sense a fire occurring in a facility and trigger a fire response to provide a notification of the fire to occupants of the facility. A fire response can include visual and/or audio alarms, for example. A fire response can also notify emergency services (e.g., fire departments, police departments, etc.) In some examples, a plurality of fire sensing devices can be located throughout a facility (e.g., on different floors and/or in different rooms of the facility).

A fire sensing device 200 can automatically or upon command conduct one or more tests contained within the fire sensing device 200. The one or more tests can determine whether the fire sensing device 200 is functioning properly, requires maintenance, and/or requires recalibration.

As shown in FIG. 2A, fire sensing device 200 can include an optical scatter chamber 204 including transmitter LEDs 205-1 and 205-2 and photodiodes 206-1 and 206-2, which can correspond to the optical scatter chamber 104, the transmitter LEDs 105-1 and 105-2, and the photodiodes 106-1 and 106-2 of FIG. 1, respectively.

As previously described, the detected LED emission level and/or scatter levels can be used to determine whether fire sensing device 200 requires maintenance and/or recalibration. For example, the fire sensing device 200 can be determined to require maintenance and/or recalibration responsive to a calculated sensitivity being outside a sensitivity range.

In some examples, the fire sensing device 200 can generate a message if the device requires maintenance (e.g., if the sensitivity is outside a sensitivity range). The fire sensing device 200 can send the message to a monitoring device (e.g., monitoring device 401 in FIG. 4), for example. As an additional example, the fire sensing device 200 can include a user interface that can display the message.

The fire sensing device 200 of FIG. 2A illustrates transmitter LED 205-1, transmitter LED 205-2, photodiode 206-1, and photodiode 206-2. Transmitter LED 205-1 can emit a first light and transmitter LED 205-2 can emit a second light. In some examples, the first light can have a first wavelength and the second light can have a second wavelength. For example, transmitter LED 205-1 can be an infrared (IR) LED with a first wavelength and transmitter LED 205-2 can be a blue LED with a second wavelength. Having two or more different wavelengths can help the fire sensing device 200 detect various types of smoke. For example, a first wavelength can better detect a flaming fire including back aerosol and a second wavelength can better detect water vapor including white non-fire aerosol. In some examples, a ratio of the first wavelength and the second wavelength can be used to indicate the type of smoke.

As shown in FIG. 2A, photodiode 206-1 can be on-axis with transmitter LED 205-1 such that photodiode 206-1 directly receives the first light and receives a scatter of the second light, and photodiode 206-2 can be on-axis with transmitter LED 205-2 such that photodiode 206-2 directly receives the second light and receives a scatter of the first light. Photodiode 206-1 can detect an LED emission level of the first light and detect a scatter level of the second light. Photodiode 206-2 can detect an LED emission level of the second light and detect a scatter level of the first light.

Transmitter LEDs 205-1 and 205-2, which may be referred to herein collectively as transmitter LEDs 205, can have varying LED emission levels due to, for example, manufacturing variations. As such, transmitter LEDs 205 may require calibration prior to use. The fire sensing device 200 can calibrate the transmitter LEDs 205 by receiving a known aerosol density level, as described above. The photodiodes 206-1 and 206-2, which may be referred to herein collectively as photodiodes 206, can detect scatter levels, which can be compared with the known aerosol density level to calculate a sensitivity for each scatter path.

In some examples, the sensitivity accuracy can be improved by modifying a gain used to amplify the input signal of a photodiode 206. A gain of a photodiode 206 can be recalibrated responsive to the LED emission level, as previously described herein.

Photodiodes 206 can select between a number of gains of a variable gain amplifier (e.g., operational amplifier 325-1 and 325-2 further described in FIG. 3). In some examples, detecting an LED emission level of an on-axis transmitter LED 205 can require less gain than detecting scatter of an off-axis transmitter LED 205 because the light from the on-axis transmitter LED 205 is direct light (e.g., higher intensity) and the light from the off-axis transmitter LED 205 is indirect light (e.g., lower intensity). For example, photodiode 206-1 can select a first gain to detect an LED emission level of the first light from transmitter LED 205-1 or select a second gain to detect a scatter level of the second light from transmitter LED 205-2. Similarly, photodiode 206-2 can select a third gain to detect an LED emission level of the second light from transmitter LED 205-2 or select a fourth gain to detect a scatter level of the first light from transmitter LED 205-1.

Figure 2B:
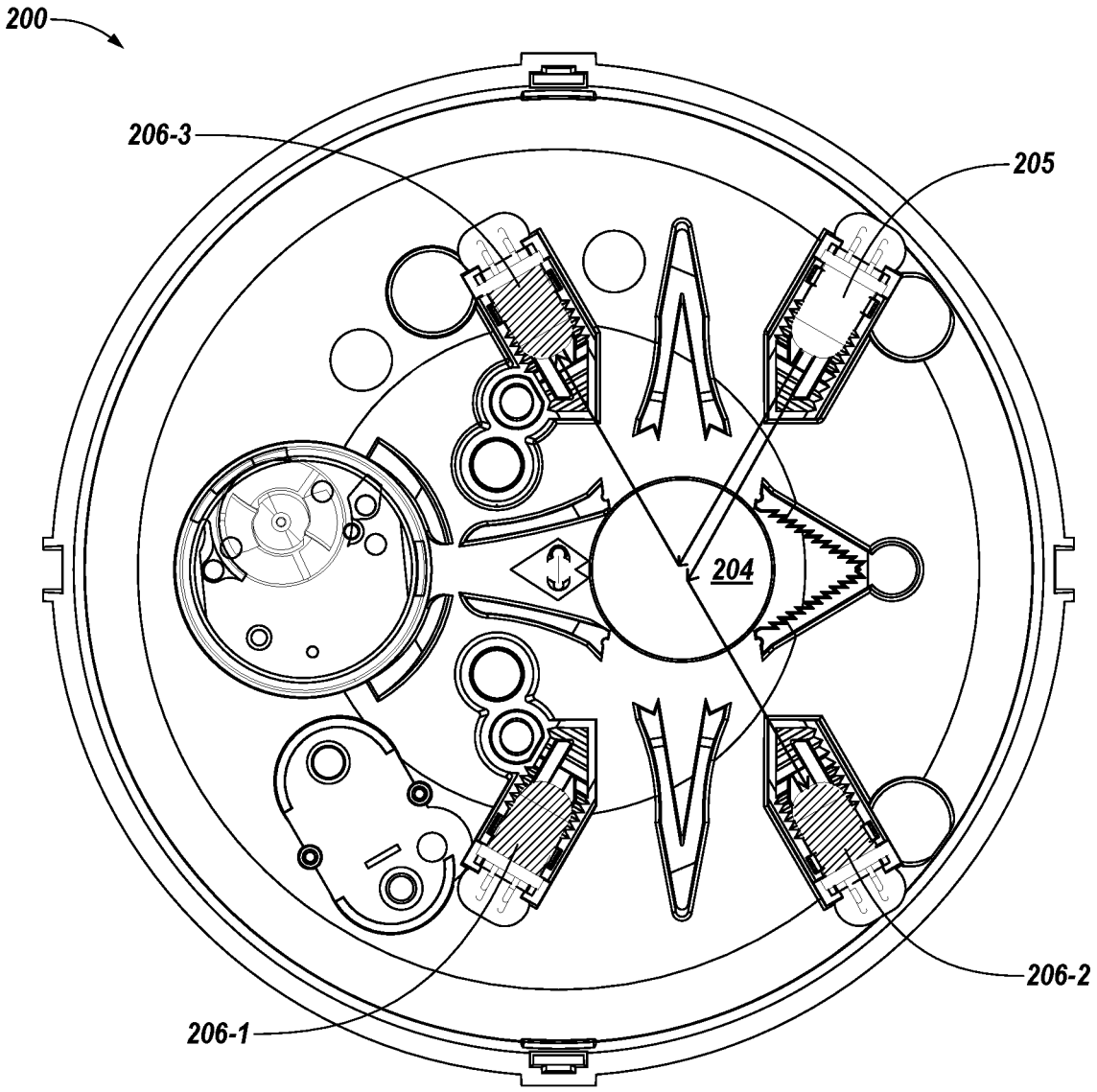
FIG. 2B illustrates an example of a self-calibrating fire sensing device in accordance with an embodiment of the present disclosure.

FIG. 2B illustrates an example of a self-calibrating fire sensing device 200 in accordance with an embodiment of the present disclosure. The fire sensing device 200 of FIG. 2B can be a dual optical smoke chamber using two different scatter angles (e.g., a forward-scatter and a backward-scatter) and can include a transmitter LED 205, a photodiode 206-1, a photodiode 206-2, and a photodiode 206-3. The fire sensing device 200 can also include an optical scatter chamber 204, which can correspond to the optical scatter chamber 204 of FIG. 2A.

Transmitter LED 205 can emit a first light. Photodiode 206-1 can be located on a first axis with transmitter LED 205 such that photodiode 206-1 directly receives the first light and photodiode 206-2 and/or photodiode 206-3 can be located on a second axis such that photodiode 206-2 and/or photodiode 206-3 indirectly (e.g., via scattering) receive the first light. In some examples, the second axis can be offset 60 degrees from the first axis.

Photodiode 206-1 can detect an LED emission level of the first light and photodiode 206-2 and/or photodiode 206-3 can detect scatter levels of the first light. Photodiode 206-2 and/or photodiode 206-3 can be located at particular angles from transmitter LED 205-1 to detect various types of smoke. For example, photodiode 206-2 can be located approximately 120 degrees from transmitter LED 205 and/or photodiode 206-1 can be located approximately 60 degrees from transmitter LED 205.

FIG. 3 illustrates circuitry 328 of a self-calibrating fire sensing device (e.g., fire sensing devices 100 and/or 200 described in connection with FIGS. 1 and 2A, respectively) in accordance with an embodiment of the present disclosure. As shown in FIG. 3, circuitry 328 can include a photodiode 306 corresponding to photodiode 106 in FIG. 1 and photodiode 206 in FIG. 2A. Each photodiode in a fire sensing device can have corresponding circuitry 328. Circuitry 328 can further include one or more configurable impedance networks 310-1, 310-2 associated with one or more operational amplifiers (op-amps) 325-1, 325-2, which can act as variable gain amplifiers, a feedback network 312, reference voltage 321, ground references 320-1, 320-2, an input signal 323, an output signal 327, and a control line 329.

As previously discussed, detecting an LED emission level of an on-axis transmitter LED will require less gain than detecting a scatter level of an off-axis transmitter LED because the light from the on-axis transmitter LED is direct light (e.g., higher intensity) and the light from the off-axis transmitter LED is indirect (e.g., scattered) light (e.g., lower intensity). The control line 329 can change the gain of op-amps 325-1 and 325-2 responsive to whether the fire sensing device (e.g., photodiode 306) is detecting an LED emission level or detecting a scatter level. For example, the op-amp 325-1 can be configured as a transimpedance amplifier (TIA) with a variable gain, so that when an input signal 323, which can be a short pulse of light of about 100 μS, is detected by the photodiode 306, a proportional photocurrent will follow in the photodiode 306. The inverting input of op-amp 325-1 can then become less than the reference voltage 321 of the non-inverting input. The op-amp 325-1 can increase its output voltage in order to supply the photocurrent via the configurable impedance network 310-1. The output voltage on the op-amp 325-1 is equal to the product of the photocurrent times the impedance of the configurable impedance network 310-1. In other words, control line 329 is able to change the impedance of the configurable impedance network 310-1 and hence the photocurrent to voltage gain of the op-amp 325-1.

An additional op-amp 325-2 can be configured as a non-inverting amplifier, which further amplifies the output voltage from the TIA op-amp 325-1. The gain of the op-amp 325-2 is determined by configurable impedance network 310-2 and as such the gain is determined by control line 329. The output signal 327 from the op-amp 325-2 can be measured by the controller (e.g., controller 122 in FIG. 1). Feedback network 312 can be used to reduce DC off-set errors and for ambient light compensation.

Emitted light from a transmitter LED may decrease over time. The controller can select a very low gain using control line 329, measure the output signal 327 corresponding to the direct output levels from an LED, then recalibrate its software gain associated with the high hardware gain, for the scatter level. As such, the change in the transmitter LED emission level can be compensated for by a change in software gain by the controller, for example, with an 8 bit resolution or 256 possible gain settings.

Figure 4:
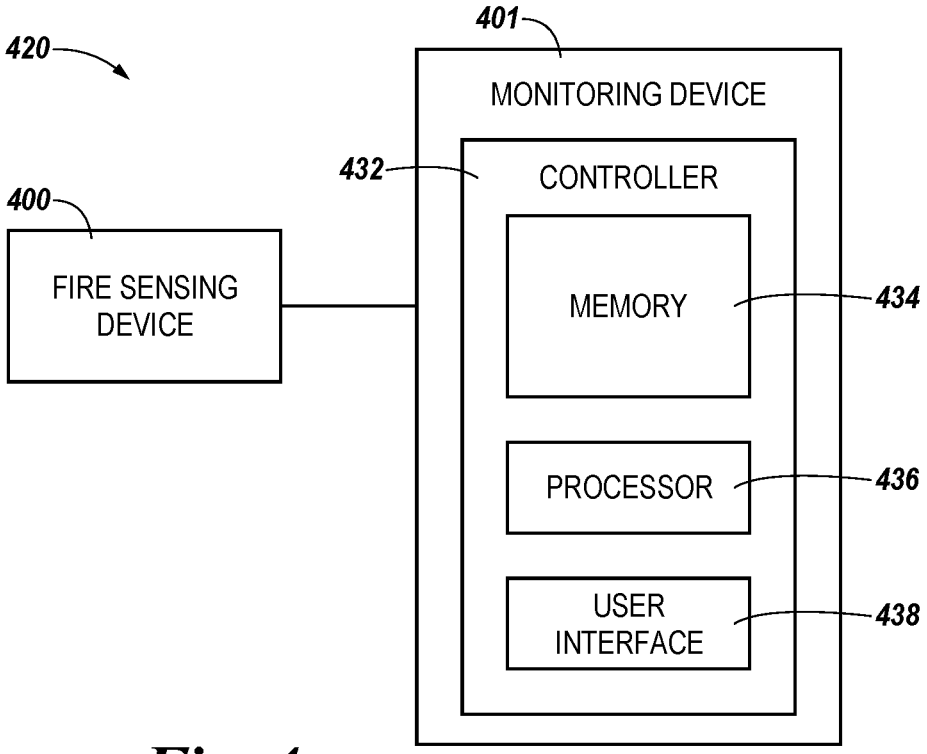
FIG. 4 illustrates a block diagram of a system including a self-calibrating fire sensing device in accordance with an embodiment of the present disclosure.

FIG. 4 illustrates a block diagram of a system 420 including a self-calibrating fire sensing device 400 in accordance with an embodiment of the present disclosure. Fire sensing device 400 can be, for example, fire sensing device 100 and/or 200 previously described in connection with FIGS. 1, 2A, and 2B, respectively. The system 420 can further include a monitoring device 401.

The monitoring device 401 can be a control panel, a fire detection control system, and/or a cloud computing device of a fire alarm system, for example. The monitoring device 401 can be configured to send commands to and/or receive test, calibration, and/or recalibration results from a fire sensing device 400 via a wired or wireless network. For example, the fire sensing device 400 can transmit (e.g., send) the monitoring device 401 a message responsive to the fire sensing device 400 determining that the fire sensing device 400 requires maintenance and/or requires recalibration. The fire sensing device 400 can also transmit a message responsive to calibrating the fire sensing device 400, recalibrating the fire sensing device 400, detecting LED emission levels at the fire sensing device 400, and/or detecting scatter at the fire sensing device 400.

In a number of embodiments, the fire sensing device 400 can transmit data to the monitoring device 401. For example, the fire sensing device 400 can transmit detected LED emission levels and/or detected scatter levels. In some examples, the monitoring device 401 can receive messages and/or data from a number of fire sensing devices analogous to fire sensing device 400.

The monitoring device 401 can include a controller 432 including a memory 434, a processor 436, and a user interface 438. Memory 434 can be any type of storage medium that can be accessed by processor 436 to perform various examples of the present disclosure. For example, memory 434 can be a non-transitory computer readable medium having computer readable instructions (e.g., computer program instructions) stored thereon that are executable by processor 436 in accordance with the present disclosure. For instance, processor 436 can execute the executable instructions stored in memory 434 to receive detected LED emission levels, receive detected scatter levels, compare detected LED emission levels to LED emission level specification ranges, compare detected scatter levels to scatter specification ranges, transmit an error notification responsive to the detected LED emission level being outside of the LED emission level specification range, transmit an error notification responsive to the detected scatter levels being outside of the scatter specification range, determine gain settings, and/or transmit a command to the fire sensing device 400. In some examples, memory 434 can store previously detected LED emission levels, previously detected scatter levels, the detected LED emission level, the detected scatter levels, the LED emission level specification ranges, and/or scatter specification ranges.

In a number of embodiments, the controller 432 can send a command to the fire sensing device 400. The command can include gain settings for a photodiode of the fire sensing device 400. The controller 432 can determine gain settings based on the detected LED emission level and/or the detected scatter level received from the fire sensing device 400. The controller 432 can compare the detected LED emission level with an LED emission level specification range, previously detected LED emission levels, and/or detected LED emission levels of a different fire sensing device and recalibrate one or more gains of one or more amplifiers based on the comparison. In some examples, the controller 432 can compare the detected scatter level with a scatter level range, previously detected scatter levels, and/or detected scatter levels of a different fire sensing device. The fire sensing device 400 can recalibrate one or more gains of one or more photodiodes based on the comparison.

In a number of embodiments, the monitoring device 401 can include a user interface 438. The user interface 438 can be a GUI that can provide and/or receive information to and/or from a user and/or the fire sensing device 400. The user interface 438 can display messages and/or data received from the fire sensing device 400. For example, the user interface 438 can display an error notification responsive to a detected LED emission level being outside of an LED emission level specification range and/or a detected scatter level being outside of a scatter specification range.

The networks described herein can be a network relationship through which the fire sensing device 400 and the monitoring device 401 communicate with each other. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network can include a number of servers that receive information from and transmit information to fire sensing device 400 and monitoring device 401 via a wired or wireless network.

As used herein, a "network" can provide a communication system that directly or indirectly links two or more computers and/or peripheral devices and allows a monitoring device 401 to access data and/or resources on a fire sensing device 400 and vice versa. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get data. Applications may also communicate with network management software, which can interact with network hardware to transmit information between devices on the network.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A self-calibrating fire sensing device, comprising:

a transmitter light-emitting diode (LED) configured to emit a light;

a first photodiode configured to detect an LED emission level of the light;

a second photodiode configured to detect a scatter level of the light;

a third photodiode configured to detect an additional scatter level of the light; and a controller configured to recalibrate a gain used by the second photodiode to detect the scatter level and recalibrate an additional gain used by the third photodiode to detect the additional scatter level responsive to the detected LED emission level of the light.

2. The device of claim 1, wherein the first photodiode is on-axis with the transmitter LED.

3. The device of claim 1, wherein the third photodiode is on-axis with the second photodiode.

4. The device of claim 1, wherein:

the second photodiode is configured to detect a first type of smoke; and the third photodiode is configured to detect a second type of smoke.

5. The device of claim 1, wherein the third photodiode is located 60 degrees from the transmitter LED.

6. The device of claim 1, wherein the second photodiode is located 120 degrees from the transmitter LED.

7. A method for operating a self-calibrating fire sensing device, comprising:

detecting, via a first photodiode, a light-emitting diode (LED) emission level of a light emitted by a transmitter LED;

detecting, via a second photodiode, a scatter level of the light;

detecting, via a third photodiode, an additional scatter level of the light;

triggering a fault responsive to the detected LED emission level of the light or the detected scatter level of the light; and recalibrating a gain used by the second photodiode to detect the scatter level and recalibrating an additional gain used by the third photodiode to detect the additional scatter level responsive to the detected LED emission level of the light.

8. The method of claim 7, wherein the method includes detecting, via the third photodiode, the additional scatter level of the light to detect different types of smoke than the second photodiode.

9. The method of claim 7, wherein the method includes:

comparing the detected LED emission level of the light to a threshold LED emission level; and triggering the fault responsive to the detected LED emission level of the light being below the threshold LED emission level.

10. The method of claim 7, wherein the method includes:

comparing the detected LED emission level of the light to a previously detected LED emission level; and triggering the fault responsive to the detected LED emission level of the light being less than the previously detected LED emission level.

11. The method of claim 10, wherein the method includes recalibrating the gain used by the second photodiode to detect the scatter level responsive to the detected LED emission level of the light being less than the previously detected LED emission level.

12. A fire alarm system, comprising:

a self-calibrating fire sensing device, comprising:

a transmitter light-emitting diode (LED) configured to emit a light;

a first photodiode configured to:

detect an LED emission level of the light; and transmit the detected LED emission level; and a second photodiode configured to:

detect a scatter level of the light; and transmit the detected scatter level;

a third photodiode configured to:

detect an additional scatter level of the light and transmit the additional detected scatter level; and a monitoring device configured to:

receive the detected LED emission level, the detected scatter level, and the additional detected scatter level of the light;

compare the detected LED emission level to an LED emission level specification range; and transmit a command to the self-calibrating fire sensing device;

wherein the self-calibrating fire sensing device is configured to recalibrate a gain used by the second photodiode and an additional gain used by the third photodiode responsive to receiving the command.

13. The system of claim 12, wherein the transmitter LED and the first photodiode are on a first axis and the second photodiode and the third photodiode are on a second axis, wherein the second axis is offset 60 degrees from the first axis.

14. The system of claim 12, wherein the monitoring device is configured to:

receive the detected additional scatter level of the light from the third photodiode; and compare the detected scatter level to the additional scatter level.

15. The system of claim 12, wherein the monitoring device is configured to compare the detected scatter level to a scatter specification range.

16. The system of claim 12, wherein the monitoring device is configured to transmit an error notification responsive to the detected LED emission level of the light being outside of the LED emission level specification range.

* * * * *